United States Patent [19]

Spitz

[11] 4,261,059

[45] Apr. 14, 1981

[54] INCLEMENT ENVIRONMENT JACKET AND VEST GARMENT

[76] Inventor: Louis Spitz, 3019 S. Grand Ave., Los Angeles, Calif. 90007

[21] Appl. No.: 7,394

[22] Filed: Jan. 29, 1979

[51] Int. Cl.[3] ..... A41D 1/02

[52] U.S. Cl. ..... 2/108; 2/126

[58] Field of Search ..... 2/108, 102, 126, 92, 2/94, 271, 87; 24/30

[56] References Cited

U.S. PATENT DOCUMENTS

| | | | |
|---|---|---|---|
| 1,505,053 | 8/1924 | Millhauser | 2/126 |
| 4,006,495 | 2/1977 | Jones | 2/93 |

FOREIGN PATENT DOCUMENTS

| | | | |
|---|---|---|---|
| 804421 | 6/1960 | United Kingdom | 2/126 |
| 840421 | 7/1960 | United Kingdom | 2/126 |

*Primary Examiner*—Doris L. Troutman

*Attorney, Agent, or Firm*—Marvin H. Kleinberg

[57] ABSTRACT

An insulation-filled jacket has removably fastened sleeves, and retaining means for attaching the sleeves, when removed, to the inside of the jacket thereby increasing the depth of insulation over substantial surface areas of the jacket. The retaining means are positioned to hold the sleeves so as to maximize the surface area of the sleeves presented, and the depth of insulation afforded to the wearer at critical heat loss locations of his body, in order to minimize critical heat loss and to retard hypothermia. The retaining means may include fastening components constructed integrally with the removable sleeves.

9 Claims, 8 Drawing Figures

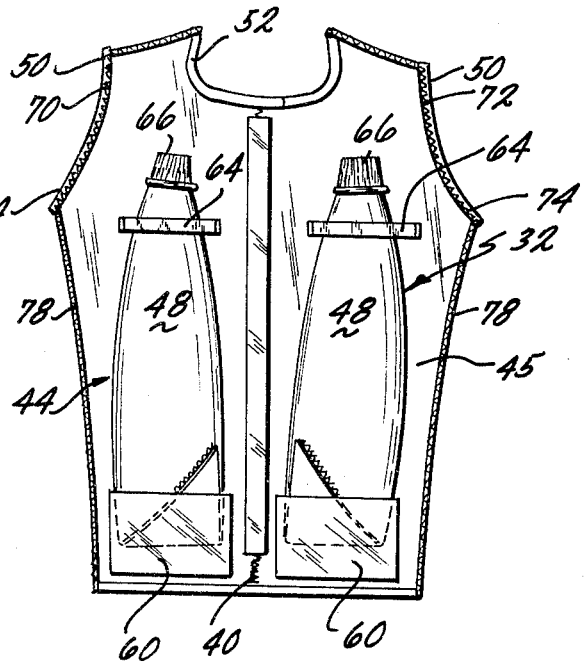
FIG. 3
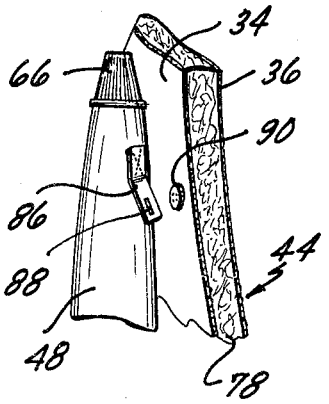
FIG. 7
FIG. 6
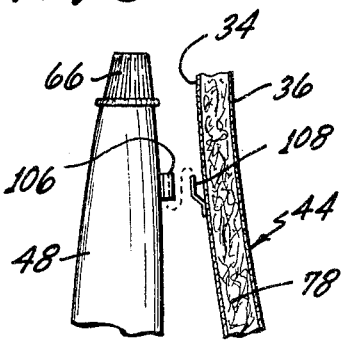
FIG. 8
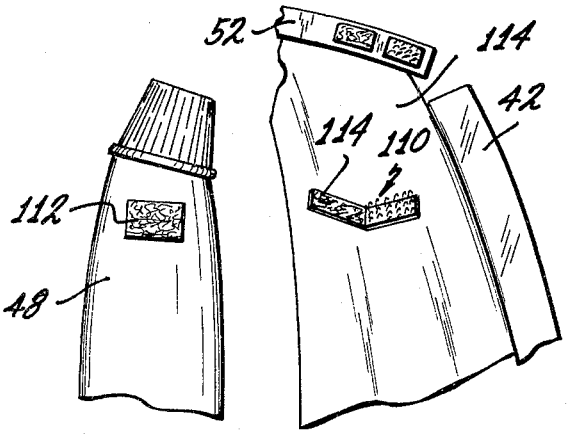

INCLEMENT ENVIRONMENT JACKET AND VEST GARMENT

BACKGROUND OF THE INVENTION

1. Field of the Invention

The present invention relates to severe environment jackets providing insulation to the torso and arm portions of the body, and more particularly relates to such jackets having removable sleeves and designed for use in areas where there is a danger of hypothermia.

2. Description of the Prior Art

It is customary in very severe and cold environments to wear large, well insulated jackets for retaining body heat and to protect the body against the cold elements whether for active work or strenuous play.

In very cold climates, such jackets usually are designed to cover the arms and the torso portions of the body, terminating just below the buttocks to allow the legs full freedom of movement.

Such jackets are frequently filled with down which provides for very excellent heat retention. Down filled jackets are quite bulky, however, the down filling having a tendency to expand, to spread and to occupy as much volume as the jacket design will allow. Alternatively, many jackets are filled with synthetic fibers with somewhat lesser insulating qualities for the same volume but are nonetheless of comparable thickness, enough to hamper arm movement. As a consequence, down or fiber filled vests which cover only the back and chest portions of the wearer from the neck to the waist have become popular with active, cold environment workers and sportsmen. Such vests are open at the arms to allow the arms full freedom without the bulk of jacket insulation.

As used in this specification, the term "jacket" is used to indicate an outer garmet for covering the trunk or torso of the body, and may or may not necessarily include sleeves. The term "vest" or "vest portion" is used to indicate a covering for the trunk of a body but would not include covering over the arm, except for some incidental covering of the arm around the shoulder portion, in accordance with the particular construction of the jacket arrangement.

With vests, the heat loss through the opening can be excessive. When the temperature drops, the wearer usually requires arm coverings. It has been known to provide cold environment jackets with removable sleeves, so that the wearer has the option of having sleeves which hinder arm movement while providing additional body covering, or of removing the sleeves to allow for vigorous arm movement when necessary. Such sleeves are usually fastened to the vest or torso portion with a zipper fastening arrangement, although other fasteners may have been used.

Some persons working in a very cold environment have found that despite the cold, it is necessary to have full freedom of the arms in order to perform certain tasks. For example, paramedics and physicians who regularly patrol ski slopes often find that it is highly desirable to have no bulky arm sleeves while they are working vigorously on an unfortunate skier downed on the slopes. Some ski slope workers, such as those on dynamite patrol and lift line repair also find that regardless of the temperature, it is necessary to have full freedom of the arms in order to accomplish difficult tasks swiftly.

However, such workers and medics find it desirable, even necessary to have insulating sleeves covering their arms when going to and from the locations of their tasks, or while skiing generally on the slopes. It is necessary therefore to remove the sleeves and to dispose of them somewhere around the work location while attending their tasks. The sleeves while lying in the environment get wet and are quite useless, but nonetheless have a substantial amount of insulation.

It is highly desired to maximize the heat loss protection afforded to a worker in a very cold environment, in spite of the requirement to remove the sleeves from his jacket at certain times. It is also desired to take maximum advantage of all heat insulating material when the environment is severe and cold, in order to avoid hypothermia.

In brief, in accordance with one aspect of the invention, a combination jacket and vest garment is provided having bulk type insulation protecting the back and the chest of a wearer. The vest is closed in the front by a zipper connecting vertically across the stomach and chest portion of the torso. An extended neck portion covers the neck. Sleeve portions are provided which can be removably attached to arm openings in the vest to form the jacket. The arm sleeves have insulation fill similar to that comprising the vest portion. The arm sleeves terminate at an outer end in a wrist designed to fit elastically to provide a reasonably air tight end around the wrists to prevent air drafts coming therethrough. The jacket has retaining means for attaching the arm sleeves within the jacket in a predetermined coalition.

When a sleeve is removed, the end having the fastening device for coupling the sleeve to the vest can be inverted inside the sleeve itself to present a generally cylindrical end to the sleeve. This end is then suitable to fit within an inside pocket positioned on the inside of the front flaps of the vest. A strap horizontally aligned and connected to the inside of the jacket can receive the other end of the arm sleeve to hold the arm sleeve in a generally vertical orientation inside the vest.

The sleeve then forms an additional layer of insulation over a substantial and large area of the chest and stomach when the jacket is closed. The increased insulation provides a substantial reduction in heat loss from those areas, where heat retention is critical in preventing hypothermia. The strap may be constructed having a fastening type retaining surface, such as a Velcro, hook and pile arrangement to secure the arm sleeve in the retained orientation on the inside of the jacket. Other retaining means and fastening means are available.

Varying orientations of the additional insulation provided by the detached arm sleeves are described in alternative embodiments. Alternative embodiments, further, include front pocket arrangements for retaining working tools in a vertical opening pocket, while providing a side opening entrance for hand warming purposes.

The novel features which are believed to be characteristic of the invention, both as to organization and method of operation, together with further objects and advantages thereof, will be better understood in the following description considered in connection with the accompanying drawing in which several preferred embodiments of the invention are illustrated by way of example. It is to be expressly understood, however, that the drawings are for the purpose of illustration and description only, and are not intended as a definition of the limits of the invention.

BRIEF DESCRIPTION OF THE DRAWINGS

FIG. 3 is a view of the front of the jacket from the inside showing the preferred embodiment of the invention and construction detail;

FIG. 6 is a detail view showing a portion of the jacket in elevational cross-section and a sleeve, to illustrate an alternative embodiment of the retaining means;

FIG. 7 is a partial view of an alternative embodiment of the invention, showing the jacket in cross-sectional elevation and a portion of the arm sleeve; and FIG. 8 is a partial view of the sleeve and jacket interior showing yet another alternative embodiment of the invention.

DESCRIPTION OF THE PREFERRED EMBODIMENT

Figure 1:
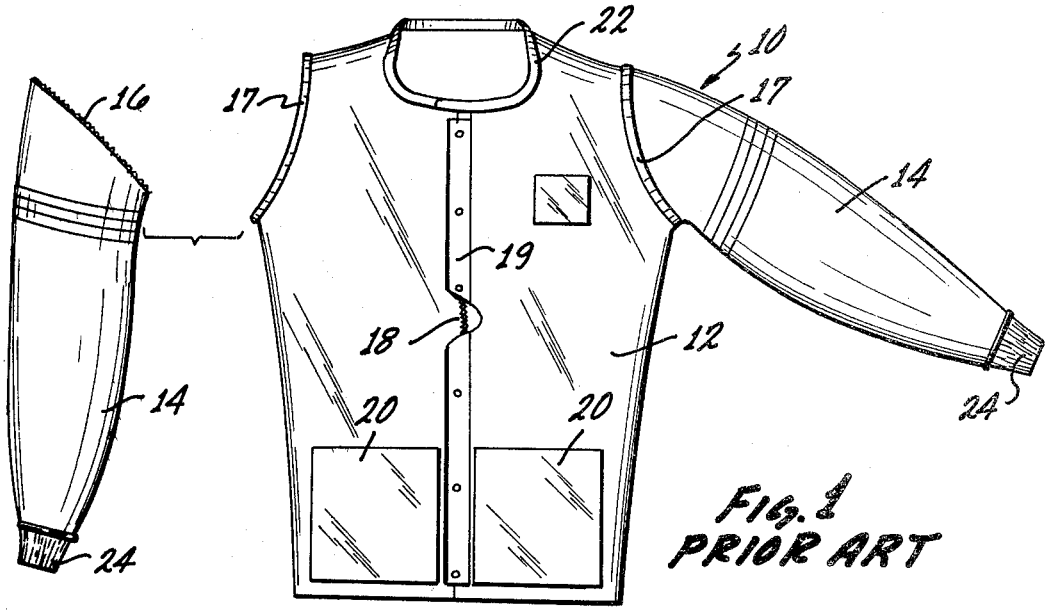
FIG. 1 PRIOR ART
FIG. 1 is a perspective view of a jacket having detachable sleeves of the prior art.

Referring initially to FIG. 1 in the accompanying drawings, a jacket 10 of the prior art is shown comprised of a vest portion 12 and detachable sleeves 14. The sleeves 14 are attached to the vest 12 by a zipper 16 having its complemental zipper portion arranged on the shoulder seams of the vest, covered by fly 17. The jacket is closed by a zipper 18 arranged vertically in the front of the jacket. The fly 17 may include additional fastening means, for example snap fasteners, to provide protection against heat loss or wind entrance through the zipper 16. Pockets 20 are usually provided.

The jacket 10 has an extended neck or collar 22. The collar 22 provides additional covering for the body, but attempts to close on the neck to prevent air drafts from flowing inside the jacket when worn. Preferably the collar 22 is filled with insulation also. A similar flexible covering 24 is provided on the ends of the sleeves 14.

The jacket 10 comprises an inside ply and an outside ply having insulating fill stuffed therebetween. The fill frequently is goose feather down, but could be synthetic fiber fill. Such insulation is usually very bulky, resulting in a very bulky jacket since the heat retaining and insulating properties of the filling are dependent upon the volume occupied by the fill. The same insulation is also used in the sleeves 14, making them as bulky as the vest 12.

Removing the sleeves from the worker increases the area exposed or at least the area not insulated, consequently increasing body heat loss potential. When the deep inner, interior portions of the body start to loose heat or to drop in temperature, a condition known as hypothermia is developed. Being sleeveless in severe and cold environments will increase the risk of hypothermia since heat losses in the extremities, such as the arm, will, naturally, have a tandem affect on the temperature of the bulk of the body and its inner portions. However, during period of vigorous activity, the arms' vigorous movement creates a capillary action which tends to compensate for the extreme cold in which they are working. The increased blood flow and blood supply gives to the arm a certain ability to take care of itself in a fashion and to maintain suitable skin temperature in spite of the significant, or very large surface-to-volume ratio that the arm presents.

The chest and stomach, on the other hand, immediately overlie the inner portions of the body, and heat loss through the chest and stomach is consequently much more critical. If the chest and stomach begin allowing heat to radiate therefrom without consequent or sufficient heat being generated in the torso, the possibility of hypothermia becomes very real.

The back portion similarly covers the inner portion of the body torso. Unlike the stomach, however, the back is to some degree insulated by the bone structure. Moreover, most jackets and parkas worn in cold environments have a solid back construction which effectively prevents wind drafts from seeping through. The front portion, in contradistinction to jacket backs, has a zippered front opening which, even when fastened, tends to leak air. In the way jackets are frequently worn, a slight opening exists in the front of the neck area, since it is uncomfortable to have something held tightly against the front of the neck. As a consequence, heat loss through the stomach, and through the front of the body in general is significantly more, making protection of the front more determinative and crucial of hypothermia.

By the present invention, a very substantial part, clearly more than half, of the surface area of the chest and stomach are given an increase in insulation thickness during those times when it is most needed, i.e. when it is desired to remove the sleeves from the jacket and expose more body surface to heat loss. Utilization of the present invention should consequently compensate for possible heat loss through the arms, and thus retard the onset of hypothermia.

The present invention also takes maximum advantage of the insulation available when it is required or necessary to remove the sleeves in order to give the jacket wearer more liberty of arm movement in the cold or severe environment.

Figure 2:
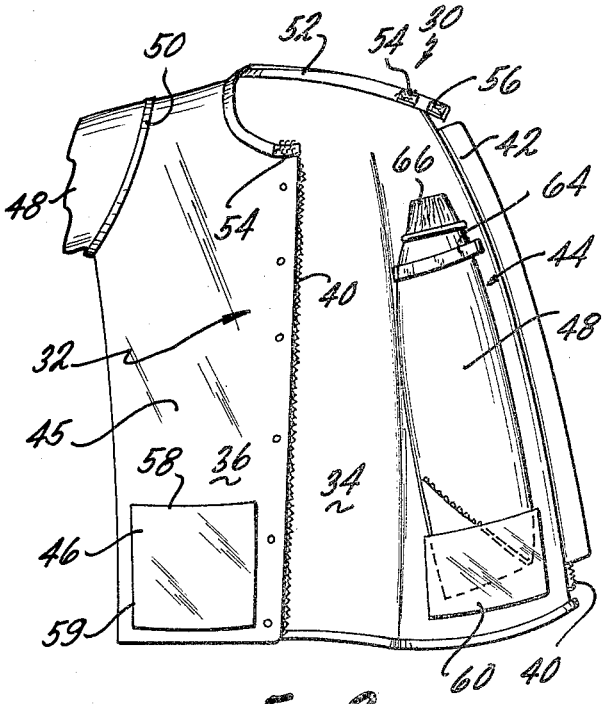
FIG. 2 is a perspective view of the preferred embodiment of the invention, having one flap of the jacket opened to reveal interior particulars of the arm sleeve retention.

In FIG. 2, in accordance with one aspect of the present invention, is illustrated a vest portion 32 of a jacket 30 having inside panels or plies 34 and outside panels or plies 36 with insulation fill stuffed therebetween. The inside plies 34 are interior facing, i.e. they face the body of the wearer. The vest 32 has a left front flap 44 and a right front flap 45 which are closed vertically along the front by means of a zipper 40. Sleeves 48 are removably fastened to the vest 32 by means of a zipper, not shown in this view because it is hidden behind the fly 50 in FIG. 2.

The complemental portion of zipper 36 is on the outside of fly 42, and consequently is not shown in this view. Pockets 46 are provided on the jacket's outside panels 36 for storing goods. A raised neck or collar 52 has a Velcro type hook portion 54 and pile portion 56 for securing the neck when the jacket 30 is being worn. The outside pocket 46 has an opening along its top edge 58 and an opening along its outside side edge 59. Thus, tools and other elements of the wearer's trade can be inserted vertically in the pocket 46 from the top edge 58. The opened side edge 59 provides an opening for arms so that the pocket 59 performs as a muff.

The jacket 30 of the present invention has a pair of inside pockets 60 opening interiorly of the jacket. Each pocket 60 is positioned near the lower end of the jacket on the inside of each of the front flaps, which normally cover the chest and stomach of the wearer. At the upper end, near the collar 48 on the inside of the flap 44, an elongated strap 64 is fastened at its two ends to the interior facing ply 34. The two ends are positioned relative to each other so that the strap 64 is aligned horizontally with respect to the wearer. The strap 64 securely holds whatever is placed between it and the inside of flap 44, but can easily release whatever is placed therethrough.

An arm sleeve 48, when removed from its respective arm opening, will have a side view at the shoulder end that is somewhat triangular, and has a resulting length greater than the height of the vest 32. Moreover, the shoulder end has a zipper, like zipper 16 in FIG. 1, protruding. For these reasons, it is believed more advantageous to tuck the shoulder end of the sleeve 14 into the interior of the sleeve. The tuck is sufficient to make the length of the sleeve 48 comparable to the height of the flap 44.

The tuck of the sleeve is then inserted into the inside pocket 60 and the wrist 66 of the sleeve 48 is threaded between the strap 64 and the inside ply of flap 44. The sleeve 48 is then vertically aligned or oriented on the inside of the vest 32. The remaining sleeve can be similarly retained against the inside of flap 45 which has a construction substantially similar to the inside of flap 44.

The placement of the sleeves thus within the inside of the flaps 44,45 increases the depth of insulation covering a substantial portion of the chest and stomach areas. Since the sleeves when flattened have a thickness double that of the jacket itself, the practice of the present invention can increase the insulation by as much as a factor of three, or can make the depth of insulation over the chest and stomach as much as 150% of its original depth. Even allowing for compression of the insulating fill, the amount of insulation protecting the front of the torso can be increased appreciably.

FIG. 3 shows a front elevation of a jacket seen from the inside in accordance with the present invention of FIG. 2. The vest 32 comprises the two front panels which are shown as fastened together. The sleeves 48, shown detached, from the assembly are inserted in the retaining means comprising the pockets 60 and straps 64. The zipper teeth 70, 72 covered by the flies 50 border the arm openings 74. The shoulder ends of the sleeves 48 are tucked to present a generally even end for insertion in the pockets 60. In this view, the front zipper 40 and the collar 52 are fastened at the front. The sleeve wrists 66 rest between the strap 64 and the flaps 44,45 to give the sleeves a vertical orientation when so inserted in the jacket. Bulk insulation 78 is shown stuffed between the inside and the outside plies of the garment construction.

Figure 4:
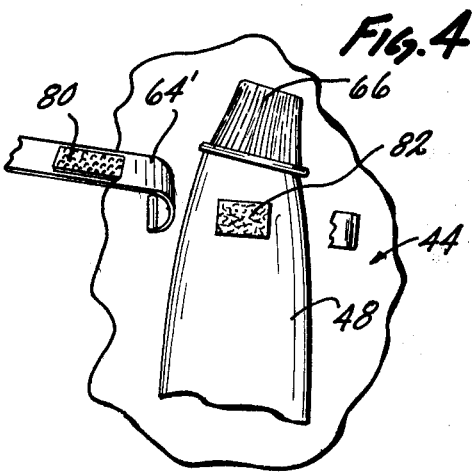
FIG. 4 is a partial view of an arm sleeve and interior of the jacket, showing the strap cutaway to reveal an alternative retaining means for the invention.

Turning now to FIG. 4, a different version of a strap 64' has a Velcro fastening construction to assist the strap in retaining the sleeve 48 to the jacket interior. The strap 64' is shown cutaway and peeled back to reveal the hook portion 80 of a Velcro fastening. The pile portion 82 of the Velcro fastening system can be permanently attached to the outside of the sleeve 48. The hooks 80 are easily snagged on other garments, and thus is particularly well suited for placing on the inside of strap 64 where it will not snag inner clothing. Yet when the hook 80 and pile 82 complemental portions of the Velcro fastener arrangement are connected together as when the wrist 66 is placed between the strap 64 and the flap 44, the Velcro fastening components 80 and 82 can effectively engage each other to hold the sleeve 48 in the vertical orientation to the wearer.

Figure 5:
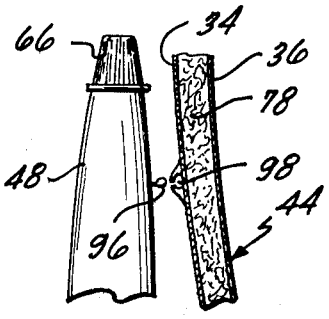
FIG. 5 is a partial view of the sleeve and jacket interior showing an alternative embodiment of the invention.

The strap 64 is, it may be appreciated, only one of several operable securing means capable of holding the end of the sleeve against its respective flap. FIG. 5 illustrates in a partial, cross-sectional side elevational view, a snap fastener securing means for securing the wrist end of the sleeve 48 to the inside of the flap 44. At the wrist end of the sleeve, the stud part 96 of a snap fastener is permanently sewed or constructed on the outside ply of the sleeve 48. The retaining component 98 of the snap fastener is permanently constructed on the inside ply 34 of the flap 44. In this manner, no sharp object is presented to the skin or body of the jacket wearer. When it is desired to utilize the present invention in the torso increased insulation mode, the shoulder portion of the sleeve 48 is inserted in one of the pockets 60. The sleeve 48 is oriented in a vertical direction, having the stud 96 aligned with and joined to the retaining component 98. When the snap is snapped closed, the wrist 66 will be retained in a vertical orientation.

In FIGS. 5 and 6, the jacket flap 44 is shown in partial cross-section to illustrate detail of garment construction. Thermal insulation 78 is stuffed between the outside ply 36 and the inside ply 34. Such insulation 78, which may be goose feather down, is usually bulky. In some cases the bulk is so thick that freedom of articulated movement is restrained.

FIG. 6 illustrates yet another alternative embodiment for securing the upper end of the sleeve 48 to the flap 44. A loop 106 is constructed on the outside of the sleeve 48. A hook 108, constructed for example of metal is fastened to the inside ply 34 of the flap 44, having an upwardly directed opening. The hook is permanently constructed on the inside ply 34 near the upper end of the flap and the shoulder of the garment, as is the retaining component 98 of the embodiment of FIG. 5. When it is desired to insert the sleeves 48 inside the vest, the loop 106 is inserted between the hook 108 and the inside ply 34 to secure the wrist 66 near the upper end of the jacket interior.

Another securing method is shown in FIG. 7, which calls for a tab 86 having a button hole 88 for receiving a button 90 sewn to the inside ply 34. Other fastening systems may readily occur to the skilled artisan.

FIG. 8 shows yet another alternative embodiment which may be used to secure the wrist end of the sleeve to the jacket interior. The jacket interior of one flap 44 with portions of the collar 52 and front fly 42 is shown having a Velcro hook fastener 110 sewn or otherwise constructed on the interior face. The sleeve 48 has a complemental patch 112 of the pile part of the Velcro fastening arrangement near the wrist. Since the Velcro hook part 110 tends to snag on other clothing when exposed, a pile flap 114 may be connected at one edge of the hook part 110 and adapted for closing over the hook part when the sleeve 48 is not secured to the flap 44.

Although particular embodiments of the invention have been described and illustrated herein, it is recognized that modifications and equivalents may readily occur to those skilled in the art. For example, the positioning of the detached sleeves 48 can be predetermined or selected to be at different orientations on the interior of the jacket, as well as different locations on the jacket. The arm sleeves 48, for example, could be placed in a horizontal orientation along the back side of the jacket interior, or in the alternative could be placed in a vertical position but more along the sides of the interior of the jacket so as to face the sides of the wearer's torso. Further, Velcro, snap, button and other types of fasteners may be used instead of, or in addition to the inside pocket 60 for securing the shoulder end of the sleeves to the flap interior. Still other modifications and equivalents may occur to those skilled in the art. Consequently, it is intended that the claims be interpreted to cover such modifications and equivalents, and that the invention be limited only thereby.

What is claimed is:

1. An outer wear jacket for use in substantially inclement environments for providing insulation over a surface area of the torso, and having removable arm sleeves attachable thereto, comprising:

a torso portion adapted to fit at least around the back and chest of a wearer and adapted to be fastened in front of the chest, having arm openings through which the wearer's arms can pass when the jacket is worn, and having an inside facing the wearer's chest and back when worn;

arm sleeves adapted to be removably fastened to said jacket arm openings and to receive the arms of a wearer when so fastened, each said arm sleeve having two ends; and retaining means positioned on said jacket inside for retaining said arm sleeves to the jacket when said arm sleeves are removed from said arm openings, said retaining means comprising a pair of pockets, each pocket having an opening and depth into which one end of one of said sleeves is adaptable for fitting, and at least one securing means positioned in relationship to said poacket for retaining the other end of said arm sleeve for increasing the thickness of the jacket over a predetermined area of the jacket for added warmth when the jacket is worn as a vest.

2. The jacket of claim 1 wherein said securing means comprise an elastic strap having two ends attached to said jacket and said side in a generally horizontal alignment in relation to each other, said strap being attached to said jacket inside in relation to its associated pocket to retain said sleeve in a generally vertical orientation on the inside of said jacket.

3. The jacket of claim 2 wherein said strap has one part of a hook and loop fastening means, and each said sleeve is constructed having the other complemental part of a hook and loop fastening means for removably fastening one end of said sleeve to said strap.

4. The jacket of claim 1 wherein said securing means comprises a fastener component positioned on said jacket inside, and wherein said sleeve includes a complemental fastener component positioned to be in alignment when said arm sleeve is retained within said jacket.

5. The jacket of claim 4 wherein said securing means further comprises a tab attached to said sleeve for holding one of said fastener components.

6. The jacket of claim 4 wherein said fastener components comprise a snap fastener.

7. The jacket of claim 4 wherein said fastener components comprise a hook and loop fastener.

8. The jacket of claim 4 wherein said fastener components comprise a button and button hole fastener.

9. The fastener of claim 4 wherein said fastener components comprise a hook fastener arrangement.

* * * * *